US009152109B2

(12) United States Patent
Sugawara et al.

(10) Patent No.: US 9,152,109 B2
(45) Date of Patent: Oct. 6, 2015

(54) FIXING MEMBER INCLUDING ELASTIC LAYER HAVING HEAT DIFFUSIVITY, FIXER AND IMAGE FORMING APPARATUS

(71) Applicants: Tomoaki Sugawara, Kanagawa (JP); Yuko Arizumi, Kanagawa (JP); Junichiro Natori, Kanagawa (JP); Tsuneaki Kondoh, Kanagawa (JP)

(72) Inventors: Tomoaki Sugawara, Kanagawa (JP); Yuko Arizumi, Kanagawa (JP); Junichiro Natori, Kanagawa (JP); Tsuneaki Kondoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/323,053

(22) Filed: Jul. 3, 2014

(65) Prior Publication Data

US 2015/0030363 A1 Jan. 29, 2015

(30) Foreign Application Priority Data

Jul. 26, 2013 (JP) ..... 2013-155798
May 27, 2014 (JP) ..... 2014-108964

(51) Int. Cl.
*G03G 15/20* (2006.01)

(52) U.S. Cl.
CPC ..... *G03G 15/2057* (2013.01)

(58) Field of Classification Search
CPC ..... G03G 15/206; G03G 15/2057
USPC ..... 399/333
See application file for complete search history.

(56) References Cited

U.S. PATENT DOCUMENTS

| | | | | |
|---|---|---|---|---|
| 5,642,550 | A | 7/1997 | Maruyama et al. | |
| 5,896,612 | A | 4/1999 | Maruyama et al. | |
| 5,897,726 | A | 4/1999 | Shinkai et al. | |
| 6,080,255 | A | 6/2000 | Shinkai et al. | |
| 6,156,127 | A | 12/2000 | Maruyama et al. | |
| 6,493,529 | B1 | 12/2002 | Umemura et al. | |
| 7,558,520 | B2 * | 7/2009 | Sugawara et al. | 399/333 |
| 2003/0190540 | A1 | 10/2003 | Shoshi et al. | |
| 2004/0069404 | A1 | 4/2004 | Kondoh | |
| 2004/0165917 | A1 | 8/2004 | Sugawara et al. | |
| 2004/0224165 | A1 | 11/2004 | Kondoh et al. | |
| 2005/0095381 | A1 | 5/2005 | Kondoh | |
| 2005/0106483 | A1 | 5/2005 | Shoshi et al. | |
| 2005/0112487 | A1 | 5/2005 | Shoshi et al. | |
| 2005/0207806 | A1 | 9/2005 | Yoshii et al. | |
| 2005/0266331 | A1 | 12/2005 | Arizumi et al. | |
| 2006/0014021 | A1 | 1/2006 | Sugawara et al. | |
| 2006/0198666 | A1 | 9/2006 | Kondoh et al. | |
| 2007/0140758 | A1 | 6/2007 | Aze et al. | |

(Continued)

FOREIGN PATENT DOCUMENTS

| | | |
|---|---|---|
| JP | 2002-351243 | 12/2002 |
| JP | 2005-024725 | 1/2005 |

(Continued)

OTHER PUBLICATIONS

Leaflet of Bethel Corporation HRD.

*Primary Examiner* — William J Royer
(74) *Attorney, Agent, or Firm* — Cooper & Dunham LLP

(57) ABSTRACT

A cylindrical fixing member includes a substrate; an elastic layer overlying the substrate; an outermost surface release layer overlying the elastic layer; and a heat source inside. The elastic layer includes a carbon fiber and has a heat diffusivity (X) not less than $1.0\times10^{-6}$ $m^2/s$ in a direction of a rotational axis of the fixing member, and the heat diffusivity (X) is not less than 2.0 times of a heat diffusivity (Z) in a direction of thickness of the elastic layer.

8 Claims, 3 Drawing Sheets

(56) References Cited

U.S. PATENT DOCUMENTS

| | | | |
|---|---|---|---|
| 2008/0069612 | A1 | 3/2008 | Nakamura et al. |
| 2008/0138123 | A1 | 6/2008 | Kondoh et al. |
| 2009/0003903 | A1 | 1/2009 | Katano et al. |
| 2009/0022527 | A1 | 1/2009 | Nakamura et al. |
| 2009/0067868 | A1 | 3/2009 | Arizumi et al. |
| 2009/0263584 | A1 | 10/2009 | Katano et al. |
| 2009/0324309 | A1 | 12/2009 | Nakamura et al. |
| 2010/0119269 | A1 | 5/2010 | Kondoh et al. |
| 2010/0129123 | A1 | 5/2010 | Natori et al. |
| 2010/0310290 | A1 | 12/2010 | Sugawara |
| 2011/0002718 | A1 | 1/2011 | Katano et al. |
| 2011/0013957 | A1 | 1/2011 | Katano et al. |
| 2011/0217098 | A1 | 9/2011 | Tomono et al. |
| 2011/0229231 | A1 | 9/2011 | Kaneko et al. |
| 2011/0268480 | A1 | 11/2011 | Katano et al. |
| 2012/0135342 | A1 | 5/2012 | Katano et al. |
| 2012/0322967 | A1 | 12/2012 | Kondoh et al. |

FOREIGN PATENT DOCUMENTS

| | | |
|---|---|---|
| JP | 2005-273771 | 10/2005 |
| JP | 2006-259712 | 9/2006 |
| JP | 2006-267231 | 10/2006 |
| JP | 2009-031772 | 2/2009 |
| JP | 2009-229616 | 10/2009 |
| JP | 2010-151960 | 7/2010 |
| JP | 2012-037874 | 2/2012 |

* cited by examiner

FIXING MEMBER INCLUDING ELASTIC LAYER HAVING HEAT DIFFUSIVITY, FIXER AND IMAGE FORMING APPARATUS

CROSS-REFERENCE TO RELATED APPLICATIONS

This patent application is based on and claims priority pursuant to 35 U.S.C. §119 to Japanese Patent Application Nos. 2013-155798 and 2014-108964, filed on Jul. 26, 2013 and May 27, 2014, respectively in the Japan Patent Office, the entire disclosure of which is hereby incorporated by reference herein.

BACKGROUND

1. Technical Field

The present invention relates to a fixing member, a fixer and an image forming apparatus.

2. Description of the Related Art

A heater passing a sheet-shaped material through a nip between a fixing member and a pressing member while sandwiching the material to heat the material is known. Specific examples thereof include image heating fixers in image forming apparatuses such as electrophotographic copiers, electrostatic recorders and laser beam printers (LBP). An unfixed toner image is formed with a heat fixable toner including heat meltable resins, using any desired image forming process such as electrophotography, electrostatic recording and magnetic recording. The unfixed toner image is directly or indirectly transferred onto a recording material such as an electrofax sheet, electrostatic recording sheet, transfer material sheet or print paper. The image heating fixer fixes the unfixed toner image on the recording material with heat as a fixed image.

Conventionally, for the image heating fixers, a heat roller method is mostly used. In such a method, a recording material is transferred between a pair of rollers formed of a heat roller as a fixing member that is controlled to have a predetermined temperature and a pressure roller as a pressure member having an elastic layer and that is caused to contact the heat roller. As the recording material passes a nip formed by the rollers, a toner image is fixed on the recording material with heat and pressure.

Recently, fixing members including a low-heat-capacity heat roller having a heat source inside, a metallic belt or a heat-resistant film (fixing film) have been used to start up the fixer at high speed while saving energy. In such a heating fixer, a low-heat-capacity heating element is used to save electricity and shorten wait time.

On the other hand, when toner images are continuously fixed on small-size recording media, the fixing member has a difference in heat discharge between a heat roller part (paper passing part) a recording medium such as a print sheet contacts, and the other heat roller part (non paper passing part) the recording medium does not contact. Namely, the heat roller part that the recording media do not pass has a surface temperature higher than that of the heat roller that the recording media pass. This is mostly observed at the end portion of the heat roller and called "end temperature increase".

Continuous excessive end temperature increase causes damages and shorter lives of the fixing member and the pressure member, and hot offset, and further unstable runnability of a recording medium such as copy papers.

Methods of increasing heat conductivity of the pressure roller to reduce the end temperature increase are typically known as disclosed in Japanese Patent No. JP-4508692-B1

(Japanese published unexamined application No. JP-2006-273771-A), and Japanese published unexamined applications Nos. JP-2009-31772-A, JP-2010-151960-A and JP-2012-37874-A.

However, heat tends to escape from the pressure roller having high heat conductivity, resulting in increase in power consumption.

SUMMARY

Accordingly, the inventors of the present invention have found that a need exists for a fixing member capable of avoiding the end temperature increase while suppressing the power consumption.

Another object of the present invention is to provide a fixer using the fixing member.

A further object of the present invention is to provide an image forming apparatus using the fixer.

These objects and other objects of the present invention, either individually or collectively, have been satisfied by the discovery of a cylindrical fixing member, including a substrate; an elastic layer overlying the substrate; an outermost surface release layer overlying the elastic layer; and a heat source inside. The elastic layer comprises a carbon fiber and has a heat diffusivity (X) not less than $1.0\times10^{-6}$ $m^2/s$ in a rotation-axial direction of the fixing member, and the heat diffusivity (X) is not less than 2.0 times of a heat diffusivity (Z) in a direction of thickness of the elastic layer.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
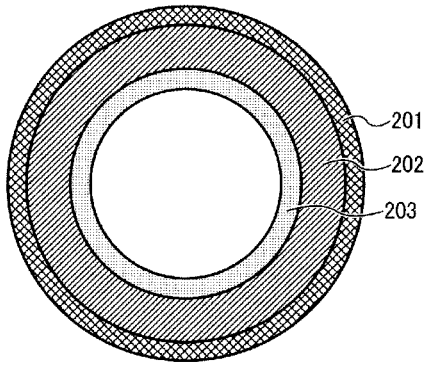
FIG. 1 is a schematic cross-sectional view illustrating an embodiment of the fixing member of the present invention.

At least one embodiment of the present invention provides a fixing member capable of avoiding the end temperature increase while suppressing the power consumption.

The fixing member includes a substrate, an elastic layer on the substrate and an outermost surface release layer in this order, and other members when necessary.

The fixing member includes a heat source inside.

The fixing member has the shape of a cylinder.

In contrast to the conventional heat conductivity improvement of the pressure member, the embodiment of the present invention reduces the end temperature increase by heat control of the fixing member closer to the heat source.

Conventionally, heat conductivities of materials of the fixing member and the pressure member used in the fixer are mostly discussed. In steady heat conduction, a heat conductivity λ (W/mK) is a dominant parameter. However, a non-steady heat diffusion equation should be used for high-speed heat flow. A one-dimensional example is as follows.

$$\partial T/\partial t=\alpha\cdot\partial^2 T/\partial x^2 (\alpha=\lambda\rho/Cp\text{:heat diffusivity } [m^2/s])$$

wherein ρ represents a density, Cp represents a specific heat. T represents a temperature, t represents a time and x represents a position.

As this formula shows, the heat diffusivity directly means when the time matters.

In the following embodiments of the present invention, the fixing member has a larger heat diffusivity in a direction of thickness than in a direction of rotational axis to level the end temperature increase in the direction of rotational axis for reduction of the end temperature increase.

<Substrate>

The substrate is not particularly limited in structure, thickness, material and size.

The substrate has the shape of, e.g., a cylinder.

The substrate may have a single-layered or a multilayered structure.

The substrate is preferably formed of a heat resistant material such as metals.

Specific examples of the metals include, but are not limited to, nickel, iron, chrome or their alloys, and stainless.

The substrate preferably has the shape of a hollow cylinder including a heating medium as a heat source in terms of heat efficiency.

Specific examples of the heating medium include, but are not limited to, a halogen heater, a ceramic heater and metallic roller capable of inductively heating.

The substrate preferably has a thickness of from 20 to 150 μm, and more preferably from 30 to 100 μm in terms of heat capacity and strength. The substrate preferably has a thickness not greater than 100 μm when formed of a metal in consideration of flexibility.

<Elastic Layer>

The elastic layer includes at least a carbon fiber, and other components when necessary.

The elastic layer is preferably formed of a heat resistant elastic material.

—Carbon Fiber—

Specific examples of the carbon fiber include, but are not limited to, pitch carbon fibers formed of coal tar or petroleum pitch; and PAN (polyacrylonitrile) carbon fibers formed of synthetic fibers and acrylic resins.

The pitch carbon fibers are formed of carbonated pitch precursor (pitch fibers formed of coal tar or petroleum heavy end), and have a wide variety of properties such as low elasticity, ultrahigh elasticity and high strength. The carbon fiber having ultrahigh elasticity has good heat conductivity and electroconductivity in addition to high rigidity.

The PAN carbon fibers are formed of carbonated PAN precursor (polyacrylonitrile fiber), and have high strength and high elasticity, but have heat conductivity of about 10 W/mk. Marketed PAN carbon fibers include MLD-300 from Toray Industries, Inc.

The pitch carbon fibers are preferably used because of their good heat conductivities. As a marketed pitch carbon fiber, a carbon fiber milled NX-100 from Nippon Graphite Fiber Co., Ltd. is most preferably used. The marketed pitch carbon fibers have thickness of 50 μm, 150 μm, 250 μm, and the like. They have heat conductivities of about 900 W/mK.

On the surface of the outermost release layer of the elastic layer, 70% or more of the carbon fibers having a length not less than 100 μm are preferably orientated in a direction of the rotational axis of the fixing member and at an angle within ±30° from the direction of the rotational axis. Thus, the elastic layer has higher heat diffusivity (X) in the direction of the rotational axis of the fixing member.

The orientation can be observed from the surface of the elastic layer by a Microscope VHX-1000 with a zoom lens VH-Z100R from Keyence Corp. The angle within ±30° from the direction of the rotational axis is in a visual field when observed from the surface of the elastic layer.

—Other Components—

Specific examples of the other components included in the elastic layer include, but are not limited to, natural rubbers, SBR, butyl rubbers, chloroprene rubbers, nitrite rubbers, acrylic rubbers, urethane rubbers, silicone rubbers, fluoro silicone rubbers, fluorine rubbers and liquid fluorine elastomers. Among these, elastic rubbers including a siloxane bond in the main chain components of the molecular sequence such as silicone rubbers, fluoro silicone rubbers, fluorine rubbers, fluorocarbon siloxane rubbers and liquid fluorine elastomers are preferably used in terms of heat resistance. The fluoro silicone rubbers are more preferably used in terms of heat resistance and release agent wettability.

The elastic layer preferably includes an aperture so that the orientation of the carbon fibers has anisotropy.

Methods of forming an aperture in the elastic layer include, but are not particularly limited to, a method of using a foamer and a method of adding a hollow filler.

Specific examples of the foamers include, but are not limited to, azobisisobutylonitrile (AIBN) and foaming particles. Specific examples of the foaming particles include, but are not limited to, F-30, F-30VS, F-46, F-50D and F-55D from Matsumoto Yushi-Seiyaku Co., Ltd.

Specific examples of the hollow filler include, but are not limited to, MFL-100CA, MFL-80CA, F-80DE, F-65DE, F-80SDE and FN-80SDE from Matsumoto Yushi-Seiyaku Co., Ltd.

The elastic layer preferably has an aperture ratio, but is not limited to, of from 20 to 30%.

The aperture ratio means a volume ratio of the aperture in a volume of the elastic layer.

$$\text{Aperture Ratio (\%)}=1-[(\text{Density of Material including Aperture})/(\text{Density of Material not including Existing Foaming Particle})]$$

Samples of each of the materials are prepared to measure the density thereof by Archimedes method. Water is used in the measurement because silicone rubbers repel water, which is preferable to measure a density including an aperture.

For example, silicone rubber including the hollow filler F-80SDE in an amount of from 0.5 to 1.5 parts by weight has an aperture ratio of from 20 to 40%.

The elastic layer has a heat diffusivity (X) not less than $1.0\times10^{-6}$ $m^2/s$ in a direction of the rotational axis of the fixing member, and the heat diffusivity (X) is not less than 2.0 times of a heat diffusivity (Z) in a direction of thickness of the elastic layer, i.e., $X/Z\geq2.0$.

The heat diffusivity can be measured by an apparatus using a cyclic heat radiant temperature measuring method with a laser as a heat source such as a Thermowave Analyzer (TA3) from BETHEL Co., Ltd.

A sample the heat diffusivity of which is measured may be prepared by taking out the elastic layer from the fixing member or a sample newly prepared by the same method of forming the elastic layer on the fixing member.

The upper limit of the heat diffusivity (X) is not particularly limited, and preferably not greater than $5.0\times10^{-6}$ $m^2/s$, and more preferably not greater than $3.0\times10^{-6}$ $m^2/s$.

X/Z is preferably not less than 5.0.

The upper limit of X"Z is not particularly limited, and preferably not greater than 15.0, and more preferably not greater than 11.0.

Methods of forming the elastic layer include, but are not particularly limited to, a method of preparing a coating liquid in which a silicone rubber, a carbon fiber and a hollow filler are mixed; and applying the coating liquid on a cylindrical substrate by a ring coat method.

The ring coat method relatively displaces a cylindrical subject to be coated and a nozzle discharging a coating liquid to form a coating film on the cylindrical subject. A substrate which is the cylindrical subject is relatively displaced in a direction of the rotational axis of the fixing member relative to the nozzle to be coated.

The elastic layer is not particularly limited in thickness, and preferably has a thickness of from 150 to 500 μm.

<Outermost Surface Release Layer>

Fluorine polymers such as polytetrafluoroethylene (PTFE), polytetrafluoroethylene perfluoroalkylvinyl ether copolymer resins (PFA) and polytetrafluoroethylene hexafluoropropylene copolymers (FEP); their mixtures; heat resistant resins or rubbers in which these polymers are dispersed; and fluorine elastomers having fluorinated polyether in its silicone crosslinking reaction group can be used in the outermost surface release layer. Among these the fluorine polymers are preferably used in terms of strength and smoothness.

The outermost surface release layer may include a hollow filler and an electroconductive material as a material having low specific heat and low heat conductivity.

Methods of forming the outermost surface release layer include, but are not particularly limited to, a method of covering the elastic layer with a tubed outermost surface release layer, a wet spray coating method and a method of baking after coating a powder.

An average thickness of the outermost surface release layer is not particularly limited, and preferably from 0.1 to 30 μm, and more preferably from 1 to 20 μm. When less than 0.1 μm, the outermost surface release layer is not sufficiently formed due to thickness of the elastic layer. When greater than 30 μm, a level difference is formed on images, resulting in defective images due to gloss difference.

<Other Members>

The other members include, but are not limited to, a primer layer and an intermediate layer.

The fixing member may have a solid or a hollow structure.

FIG. 1 is a schematic cross-sectional view illustrating an embodiment of the fixing member of the present invention. The fixing member has a multilayered structure including a substrate 203, an elastic layer 202 on the substrate 203 and an outermost surface release layer 201 on the elastic layer 202. The substrate 203 is a hollow cylinder and includes an unillustrated heat source.

Figure 2:
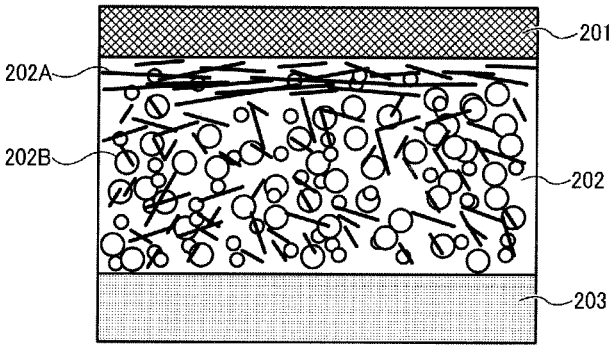
FIG. 2 is an amplified view of the fixing member in FIG. 1.

FIG. 2 is an amplified view of the fixing member in FIG. 1. A carbon fiber 202A is orientated in a direction of the rotational axis of the fixing member at the surface of the elastic layer 202 facing the outermost surface release layer 201. The carbon fiber 202A is disorderly orientated in the middle of the elastic layer 202. An aperture 202B formed by a hollow filler is present in the elastic layer 202.

Figure 3:
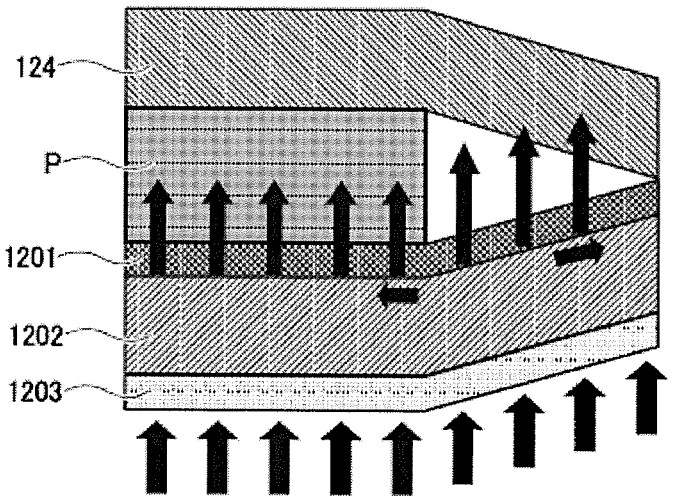
FIG. 3 PRIOR ART
FIG. 3 is a schematic view illustrating heat transfer in a fixing process using a conventional fixing member.

FIG. 3 is a schematic view illustrating heat transfer in a fixing process using a conventional fixing member. While a recording medium P is pressed by a pressure roller 124 and a fixing member (fixing roller), the recording medium P is heated by a heat source of the fixing roller. Then, heat transfers in an arrow direction in FIG. 3. Namely, at a pan of the fixing member which does not contact the recording medium P, which is an outside of the end thereof, much heat escapes to the side of the pressure roller 124. The pressure roller 124 typically has high heat insulation, the part of the fixing member which does not contact the recording medium P increases in temperature due to heat accumulation.

In FIG. 3, a numeral 1203 represents a substrate, 1202 an elastic layer and 1201 an outermost surface release layer.

Figure 4:
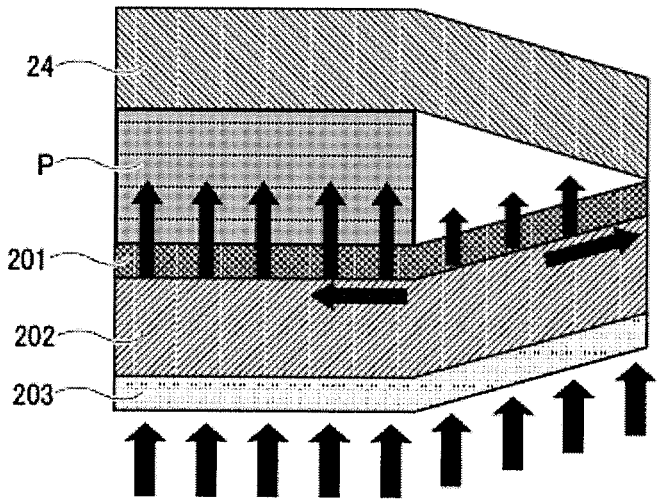
FIG. 4 is a schematic view illustrating heat transfer in a fixing process using the embodiment of the fixing member of the present invention.

FIG. 4 is a schematic view illustrating heat transfer in a fixing process using the embodiment of the fixing member of the present invention. While a recording medium P is pressed by a pressure roller 24 and a fixing member (fixing roller), the recording medium P is heated by a heat source of the fixing roller. Then, heat transfers in an arrow direction in FIG. 4. Namely, at a part of the fixing member which does not contact the recording medium P, which is an outside of the end thereof, much heat transfers in a direction of the rotational axis of the fixing roller. Therefore, the part of the fixing member which does not contact the recording medium P accumulates less heat and increases less in temperature.

(Fixer and Fixing Method)

The fixer of the present invention includes at least the fixing member of the present invention, and other members when necessary.

The fixing member includes, but is not limited to, a fixing roller.

The fixing method of the present invention locates the outermost surface release layer of the fixing member of the present invention in a direction of contacting an unfixed developer image formed of a developer when fixing the unfixed developer image on a recording medium.

Figure 5:
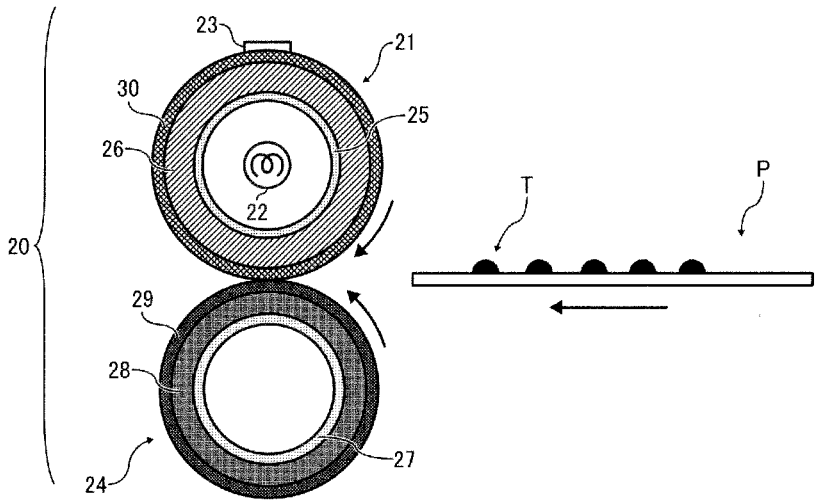
FIG. 5 is a schematic cross-sectional view illustrating an embodiment of the fixer of the present invention.

FIG. 5 is a schematic cross-sectional view illustrating an embodiment of a fixer 20 of the present invention.

The fixer 20 includes a fixing roller 21 as an embodiment of the fixing member of the present invention and a pressure roller 24.

The fixing roller 21 includes a halogen heater 22 as a heater inside. The fixing roller 21 includes a temperature sensor 23. The fixing roller 21 includes a metal core 25, an elastic layer 26 on the metal core 25, and an outermost surface release layer 30 on the elastic layer 26. The pressure roller 24 includes a metal core 27, a surface layer 28 formed of a heat resistant rubber on the metal core 27, and a release layer 29 on the surface layer 28. The pressure roller 24 contacts the fixing roller 21 with pressure and forms a nip where a recording medium P passes and a toner image T is fixed thereon.

(Image Forming Apparatus)

The image forming apparatus of the present invention includes at least the fixer 20 of the present invention, and other means when necessary such as an electrostatic latent image bearer, an electrostatic latent image former, an image developer, a transferer, a discharger, a cleaner, a recycler and a controller.

The fixer fixes a visual image transferred onto a recording medium thereon.

The fixer may fix each color toner image on the recording medium every time when transferred thereon, or layered color toner images thereon at a time.

The electrostatic latent image bearer (hereinafter referred to as "photoreceptor" occasionally) is not particularly limited in materials, shape, structure and size, but preferably has the shape of a drum. The materials includes inorganic materials such as amorphous silicon and selenium, and organic materials such as polysilane and phthalopolymethine. The amorphous silicon is preferably used in terms of long life.

The electrostatic latent image former forms an electrostatic latent image on the electrostatic latent image bearer.

The electrostatic latent image is formed by the electrostatic latent image former by uniformly charging the surface of the electrostatic latent image bearer and irradiating the surface thereof with imagewise light. The electrostatic latent image former includes at least a charger uniformly charging the surface of the electrostatic latent image bearer and an irradiator irradiating the surface thereof with imagewise light.

The surface of the electrostatic latent image bearer is applied with a voltage to be charged by the charger.

The charger includes, but is not particularly limited to, known contact chargers such as including a conductive or semiconductive roller, a brush, a film and a rubber blade; and non-contact chargers using corona discharge such as corotrons and scorotrons.

The surface of the electrostatic latent image bearer is irradiated with imagewise light by the irradiator.

The irradiator includes, but is not particularly limited to, duplicating optical systems, rod lens array systems, laser optical systems and liquid crystal shutter optical systems.

In the present invention, a back-exposure method irradiating the backside of the electrostatic latent image bearer with imagewise light may be used.

The image developer develops the electrostatic latent image with a toner or a developer to form a visual image.

The visual image is formed by the image developer by developing the electrostatic latent image with a toner or a developer.

The image developers include, but is not particularly limited to, those containing the toner or the developer and capable of applying the toner or the developer to the electrostatic latent image in contact or contactlessly.

The image developer may use a dry developing method or a wet developing method, and may be a monocolor image developer or a multicolor image developer. The image developer preferably includes a stirrer stirring the toner or the developer to be charged, and a rotatable magnet roller.

In the image developer, the toner and a carrier are stirred to be mixed, and the toner is charged by the friction and held on the surface of the rotational magnet roller in the shape of an ear to form a magnetic brush. The magnet roller is located close to the electrostatic latent image bearer, and a part of the toner forming the magnetic brush formed on the surface of the magnet roller is transferred by electrical attraction onto the surface of the electrostatic latent image bearer. As a result, the electrostatic latent image is developed with the toner to form a visual image on the surface of the electrostatic latent image bearer.

The developer including the toner may be a one-component or a two-component developer.

The transferer transfers the visual image onto a recording medium, and it is preferable that the visual image is first transferred onto an intermediate transferer and secondly transferred onto the recording medium. The First transferer transferring the visual image formed of two or more color toners, preferably full-color toners onto the intermediate transferer to form a complex transfer image and a second transferer transferring the complex transfer image onto the recording medium are more preferably included.

The intermediate transferer includes, but is not particularly limited to, transfer belts.

The transferers including the first transferer and the second transferer preferably include a transfer unit charging the visual image formed on the electrostatic latent image bearer to be peeled off therefrom to the recording medium. The transferer may be one or two or more.

The transfer unit include, but are not limited to, corona transfer units using corona discharge, transfer belts, transfer rollers, pressure transfer rollers and adhesive transfer units.

The recording media includes, but is not particularly limited to, known recording media (recording paper).

The discharger applies a discharge bias to the electrostatic latent image bearer to be discharged.

The discharger includes, but is not particularly limited to, discharge lamps.

The cleaner removes the toner remaining on the electrostatic latent image bearer.

The charger include, but is not particularly limited to, known cleaners such as magnetic brush cleaners, electrostatic brush cleaners, magnetic roller cleaners, blade cleaners, brush cleaners and web cleaners.

The recycler returns the toner removed by the cleaner to the image developer to be recycled.

The recyclers includes, but is not particularly limited to, known conveying means.

The controller controls the above means.

The controller includes, but is not particularly limited to, sequencers and computers.

Figure 6:
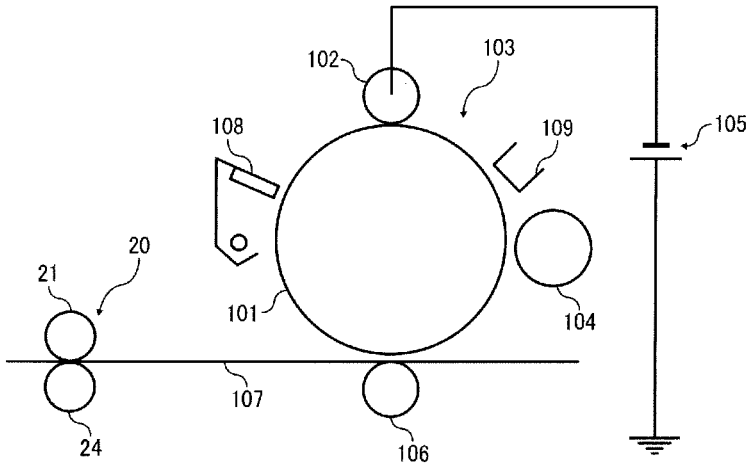
FIG. 6 is a schematic view illustrating an embodiment of the image forming apparatus of the present invention.

FIG. 6 is a schematic view illustrating a photoreceptor drum 101, an image forming system and a fixer 20 of a copier. A photosensitive layer of the photoreceptor drum 101 is uniformly charged by a charging roller 102, and irradiated with a laser beam 103 from an unillustrated laser scanning unit to form an electrostatic latent image on the photoreceptor drum 101. The electrostatic latent image is developed with a toner to form a toner image, and the toner image is transferred onto a recording medium 107. Further, the recording medium 107 is passed through the fixer 20 so that the toner image can be heated and pressed to be fixed on the recording medium 107. A numeral 104 represents a developing roller, 105 a power pack (power source), 106 a transfer roller, 108 a cleaner and 109 a surface potential meter.

The fixer 20 uses a fixing roller 21 including the fixing member of the present invention. The fixing roller 21 includes a heater such as halogen lamps in a hollow part of the metal core along the rotational center line, which efficiently heats the fixing roller 21 with a radiation heat from the inside.

The fixer includes a pressure roller 24 contacting the fixing roller 21 with pressure in parallel therewith, and passes the recoding medium 107 between the pressure roller 24 and the fixing roller 21 to fix a toner image on the recoding medium 107, pressing the toner image therebetween while softening the toner adhering on the recoding medium 107 with a heat from the fixing roller 21.

The image forming apparatus of the present invention using the fixer having improved durability and reliability of the present invention is preferably used as electrophotographic copiers, facsimiles and laser beam printers.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

<Number-Average Fiber Length>

One to two drops of a liquid including carbon fibers were placed on a slide Glass using a spuit to observe with a Keyence microscope VHX-1000 with a zoom lens VH-Z100R×300 from Keyence Corp. in a range of 800 μm×600 μm.

The lengths of the 500 carbon fibers were measured to determine a number-average fiber length from an arithmetic average.

<Carbon Fiber Orientation>

Carbon fibers in the elastic layer of a fixing member were observed with a Keyence microscope VHX-1000 with a zoom lens VH-Z100R×300 from Keyence Corp. in a range of 800 μm×600 μm.

Deflection angles of the carbon fibers having a length of 100 μm or more relative to a direction of the rotational axis were measured to determine a ratio thereof having a deflection angle of 30° or less. These were measured for 12 times while both ends and the center of the fixing member were rotated by 90°. The ratio of orientation was indicated by %.

In Examples, 70% or inure of the carbon fibers having a length of 100 μm or more were oriented at an angle not greater than ±30° in a direction of the rotational axis.

<Martens Hardness HM (ISO14577)>

An elastic layer was formed on a substrate without using a primer for silicone rubber, and peeled off from the substrate to measure a Martens hardness thereof with H100 from Fischer Technology, Inc.

A hot plate was used to measure at 150° C.

As Japanese Patent No. JP-4558307-B2 (Japanese published unexamined application No. JP-2005-164721-A) discloses, quality images are produced when Martens hardness HM (universal hardness HU: DIN) of from 0.5 to 2.2 N/mm$^2$. However, Martens hardness in Japanese Patent No. JP-4558307-B2 is a hardness including PFA, and only the elastic layer may have a hardness less than this to produce quality images.

<Heat Diffusivity>

An elastic layer was formed on a substrate without using a primer for silicone rubber, and peeled off from the substrate to measure a heat diffusivity thereof with Thermowave Analyzer (TA3) from BETHEL Co., Ltd. This uses a cyclic heat radiant temperature measuring method with a laser as a heat source, and measures not only the heat diffusivity in a direction of thickness but also in a direction of in-plane. In Tables 1 and 2, X represents a heat diffusivity in a direction of the rotational axis, Y represents that in a paper feed direction, and X represents that in a direction of thickness.

Example 1

A stainless seamless cylinder having a thickness of 40 μm was used as a substrate for a fixing belt. A primer for silicone rubber was coated on the substrate. A mixture including 100 parts of liquid silicone rubber (DY 35-2083 from Dow Corning Toray Co., Ltd.), 40 parts of a carbon fiber (XN-100 having a size of 50 μm from Nippon Graphite Fiber Co., Ltd. and 1.0 part of a hollow filler (F-80SDE having an average particle diameter of 20 to 40 μm from Matsumoto Yushi-Seiyaku Co., Ltd.) mixed by a MAZERUSTAR from Kurabo Industries, Ltd. was coated by ring coat method on the primer. This was heated at 120° C. for 30 min and fired at 200° C. for 4 hrs to form an elastic layer having an average thickness of 300 μm. After a primer for PFA tube was coated on the elastic layer, a PFA tube (outermost surface release layer having an average thickness of 15 μm) was bonded thereto to prepare a fixing member having a final outer diameter of 30 mm.

<Evaluation>

The resultant fixing member was set in a fixing unit of copier MP-C5002 from Ricoh Company, Ltd., and monochrome toner letter chart images were produced on 500 pieces of Ricoh full-color copy paper TYPE 6000 (90W) having a size of A4 and a thickness about 120 μm in a longitudinal direction. The fixing unit was set to have a temperature of 180° C. Typically, the apparatus decreases in speed when a part thereof increases in temperature, but which was arranged not to work in this evaluation.

<<Paper End Temperature Difference (Temperature Increase)>>

A thermocouple was set at the exit of the fixing belt nip 10 mm out of the paper end where a paper does not pass to measure a temperature thereof. A difference from a set temperature of the center was the paper end temperature difference (° C.). The results are shown in Table 1.

<<Power Consumption Ratio of (Only) Fixing Heater in Producing Images>>

The power consumption ($C_1$) of the last 5 min when producing 500 images was measured.

A power consumption ($C_0$) of a genuine fixing member of the copier MP-C5002 from Ricoh Company, Ltd. was 100%, and a power consumption ratio ($C_1/C_0$) was determined. The results are shown in Table 1.

The copier was set to maintain a temperature of 180° C.

<<Hot Offset>>

After 500 images were produced, a red image (yellow on magenta) was formed on a first half of a full-color copy paper TYPE 6000 (90W) having a size of A3. A trace of toner seen on the last blank half was regarded as a proof of occurrence of hot offset, and which was poor. No trace was good.

Examples 2 to 6 and Comparative Examples 1 to 7

The procedure for preparation and evaluation of the fixing member in Example 1 were repeated except for changing the materials and the content thereof as Tables 1 and 2 shows. The results are shown in Tables 1 and 2.

In Comparative Example 3, a pressure roller having high heat conductivity was used.

A mixture including 100 parts of liquid silicone rubber (DY 35-2083 from Dow Corning Toray Co., Ltd.), 40 parts of a carbon fiber (XN-100 having a size of 150 μm from Nippon Graphite Fiber Co., Ltd. and 1.5 parts of a hollow filler (F-80SDE having an average particle diameter of 20 to 40 μm from Matsumoto Yushi-Seiyaku Co., Ltd.) mixed by a MAZERUSTAR from Kurabo Industries, Ltd. was extruded between a PFA tube having a diameter of 20 μm and a substrate, and heated at 120° C. to form a mold. Then, the mold was heated at 200° C. for 4 his to form a rubber layer of the pressure roller having high heat conductivity.

Comparative Example 8

The procedure for preparation and evaluation of the fixing member in Example 1 were repeated except for changing the materials, the content thereof as Tables 2-1 and 2-2 show, and ring coat to blade coat. The results are shown in Tables 2-1 and 2-2.

TABLE 1

| | | Ex. 1 | Ex. 2 | Ex. 3 | Ex. 4 | Ex. 5 | Ex. 6 |
|---|---|---|---|---|---|---|---|
| Silicone rubber | (parts by weight) | 100 | 100 | 100 | 100 | 100 | 100 |
| Pitch XN-100 | (parts by weight) | 40 | 40 | 40 | 40 | 40 | 40 |
| Pan MLD-300 | (parts by weight) | — | — | — | — | — | — |
| Number-average fiber length | (μm) | 53 | 143 | 236 | 53 | 143 | 236 |
| F-80SDE | (parts by weight) | 1.0 | 1.0 | 1.0 | 1.5 | 1.5 | 1.5 |
| F-65DE | (parts by weight) | — | — | — | — | — | — |
| Carbon Fiber Orientation (%) | | 72 | 81 | 85 | 85 | 81 | 85 |
| Heat Diffusivity ($\times 10^{-6}$ $m^2/s$) | X: Axial Direction | 1.21 | 2.51 | 3.01 | 1.30 | 1.93 | 2.03 |
| | Y: Paper Feed Direction | 0.65 | 0.72 | 0.75 | 0.52 | 0.85 | 0.84 |
| | Z: Thickness Direction | 0.50 | 0.30 | 0.28 | 0.35 | 0.31 | 0.34 |
| | X/Z | 2.4 | 8.4 | 10.8 | 3.7 | 6.2 | 3.0 |
| HM ($N/mm^2$) Depth 10 μm | | 0.42 | 0.61 | 0.65 | 0.31 | 1.58 | 0.6 |
| Pressure Roller Heat Conductivity (W/mK) | | 0.1 | 0.1 | 0.1 | 0.1 | 0.1 | 0.1 |
| Paper End Temperature Difference | | 12 | 9 | 7 | 11 | 8 | 8 |
| Power Consumption Ratio (%) | | 85 | 81 | 80 | 83 | 82 | 80 |
| Hot Offset | | Good | Good | Good | Good | Good | Good |

TABLE 2-1

| | | Com. Ex. 1 | Com. Ex. 2 | Com. Ex. 3 | Com. Ex. 4 |
|---|---|---|---|---|---|
| Silicone rubber | (parts by weight) | 100 | 100 | 100 | 100 |
| Pitch XN-100 | (parts by weight) | — | — | — | 40 |
| Pan MLD-300 | (parts by weight) | 40 | — | — | — |
| Number-average fiber length | (μm) | 147 | — | — | 53 |
| F-80SDE | (parts by weight) | 1.5 | — | — | — |
| F-65DE | (parts by weight) | — | — | — | 1.5 |
| Carbon Fiber Orientation (%) | | 85 | — | — | 65 |
| Heat Diffusivity ($\times 10^{-6}$ $m^2/s$) | X: Axial Direction | 0.25 | 0.13 | 0.13 | 0.76 |
| | Y: Paper Feed Direction | 0.21 | 0.13 | 0.13 | 0.75 |
| | Z: Thickness Direction | 0.21 | 0.13 | 0.13 | 0.51 |
| | X/Z | 1.1 | 1.0 | 1.0 | 1.5 |
| HM($N/mm^2$) Depth 10 μm | | 0.39 | 0.2 | 0.2 | 0.31 |
| Pressure Roller Heat Conductivity (W/mK) | | 0.1 | 0.1 | 8.6 | 0.1 |
| Paper End Temperature Difference | | 23 | 34 | 15 | 30 |
| Power Consumption Ratio (%) | | 105 | 128 | 140 | 105 |
| Hot Offset | | Poor | Poor | Poor | Poor |

TABLE 2-2

| | | Com. Ex. 5 | Com. Ex. 6 | Com. Ex. 7 | Com. Ex. 8 |
|---|---|---|---|---|---|
| Silicone rubber | (parts by weight) | 100 | 100 | 100 | 100 |
| Pitch XN-100 | (parts by weight) | 40 | 40 | 45 | 55 |
| PAN MLD-300 | (parts by weight) | — | — | — | — |
| Number-average fiber length | (μm) | 143 | 236 | 236 | 53 |
| F-80SDE | (parts by weight) | — | — | — | — |
| F-65DE | (parts by weight) | 1.5 | 1.5 | 1.5 | 1.5 |
| Carbon Fiber Orientation (%) | | 67 | 52 | 52 | 50 |
| Heat Diffusivity ($\times 10^{-6}$ $m^2/s$) | X: Axial Direction | 0.79 | 0.82 | 0.92 | 1.12 |
| | Y: Paper Feed Direction | 0.72 | 0.65 | 0.71 | 1.03 |
| | Z: Thickness Direction | 0.47 | 0.42 | 0.43 | 0.78 |
| | X/Z | 1.7 | 2.0 | 2.1 | 1.5 |
| HM($N/mm^2$) Depth 10 μm | | 0.54 | 0.59 | 1.12 | 2.83 |
| Pressure Roller Heat Conductivity (W/mK) | | 0.1 | 0.1 | 0.1 | — |
| Paper End Temperature Difference | | 27 | 21 | 20 | — |
| Power Consumption Ratio (%) | | 100 | 95 | 95 | — |
| Hot Offset | | Poor | Poor | Poor | — |

PAN MLD-300 represents TORAYCA MLD-300 from Toray Industries, Inc.

F-65DE represents F-65DE having an average particle diameter of from 40 to 60 μm from Matsumoto Yushi-Seiyaku Co., Ltd.

The heat conductivity of the pressure roller in an axial direction was measured by a quick heat conductivity meter QTM-500 from Kyoto Electronics Manufacturing Co., Ltd. A rubber layer was separated from the pressure roller to measure a heat conductivity of the rubber layer.

In Examples 1 to 6, the heat diffusivities were all $1.0\times10^{-6}$ $m^2/s$ or more in a direction of the rotational axis, and 2.0 times or more of those in a direction of the thickness of the elastic layer, i.e., $X/Z\geq2.0$.

In Examples 1 to 6, the paper end temperature differences were 12° C. or less. The power consumptions of the fixing heaters were lower than those of marketed ones by 10 to 15%.

Comparative Example 1 uses a PAN carbon fiber. When the carbon fiber has low heat conductivity, the heat diffusivity does not increase and the anisotropy does not strongly come out. As a result, the paper end largely increases in temperature.

Comparative Example 2 uses only silicone rubber DY 35-2083 to form an elastic layer. The heat diffusivity of the elastic layer had isotropy and was small, resulting in increase of the paper end temperature.

Comparative Example 3 uses the same fixing member as that of Comparative Example 2 and a pressure roller having high heat conductivity. The paper end temperature was low because of high heat conductivity in a direction of the rotational axis. However, heat escapes from the pressure roller having a high heat conductivity, resulting in a high power consumption ratio.

Comparative Examples 4 to 7 use hollow fillers relatively larger than those of Examples 1 to 6. The paper end temperature differences thereof were all 20° C., and the ends had abnormal images due to hot offset. Hot offset also occurred in Comparative Examples 1 and 2. In Comparative Examples 4 to 6, the heat diffusivities were less than $1.0\times10^{-6}$ $m^2/s$, and X/Z were less than 2.0.

In Comparative Example 7, the heat diffusivity was less than $1.0\times10^{-6}$ $m^2/s$, and X/Z was not less than 2.0.

In Comparative Example 8, the heat diffusivity was not less than $1.0\times10^{-6}$ $m^2/s$, and X/Z was less than 2.0. A belt could not be formed therein due to viscosity. Martens hardness was 2.83 $N/mm^2$, which is thought unsuitable for the elastic layer of a belt.

Having now fully described the invention, it will be apparent to one of ordinary skill in the art that many changes and modifications can be made thereto without departing from the spirit and scope of the invention as set forth therein.

What is claimed is:

1. A cylindrical fixing member, comprising:

a substrate;

an elastic layer overlying the substrate and having a carbon fiber;

an outermost surface release layer overlying the elastic layer; and a heat source inside, wherein the elastic layer has a heat diffusivity (X) not less than $1.0\times10^{-6}$ $m^2/s$ in a direction of a rotational axis of the fixing member, and the heat diffusivity (X) is not less than 2.0 times of a heat diffusivity (Z) in a direction of thickness of the elastic layer.

2. The fixing member of claim 1, wherein the elastic layer comprises an aperture.

3. The fixing member of claim 1, wherein the outermost surface release layer comprises carbon fibers having a length not less than 100 μm, and not less than 70% of the carbon fibers having a length not less than 100 μm are orientated at an angle not greater than ±30° in the direction of the rotational axis.

4. The fixing member of claim 1, wherein the carbon fiber is a pitch carbon fiber.

5. The fixing member of claim 1, wherein the elastic layer comprises a silicone rubber.

6. The fixing member of claim 1, wherein the outermost surface release layer comprises a fluorine polymer.

7. A fixer comprising the fixing member according to claim 1.

8. An image forming apparatus comprising the fixer according to claim 7.

* * * * *